United States Patent [19]

DeLozier

[11] 4,223,501

[45] Sep. 23, 1980

[54] CONCRETE FORM

[75] Inventor: Howard K. DeLozier, Fort Collins, Colo.

[73] Assignee: Rocky Mountain Foam Form, Inc., Fort Collins, Colo.

[21] Appl. No.: 974,544

[22] Filed: Dec. 29, 1978

[51] Int. Cl.[3] ..... E04B 2/20; E04C 2/20

[52] U.S. Cl. ..... 52/309.11; 52/309.12; 52/426; 52/364; 52/565; 52/712

[58] Field of Search ..... 52/309.2, 309.4, 309.8, 52/309.12, 426, 565, 673, 712, 364

[56] References Cited

U.S. PATENT DOCUMENTS

| | | | |
|---|---|---|---|
| 836,589 | 11/1906 | Layfield et al. | 52/565 |
| 1,871,318 | 8/1932 | Greenwood | 52/673 X |
| 3,778,020 | 12/1973 | Burrows et al. | 249/219 R |
| 3,788,020 | 1/1974 | Gregore | 52/439 X |
| 3,872,636 | 3/1975 | Nicosia | 52/364 |
| 3,922,828 | 12/1975 | Patton | 52/309.2 |
| 3,979,867 | 9/1976 | Sowinski | 52/364 |

*Primary Examiner*—Alfred C. Perham
*Attorney, Agent, or Firm*—Bruce G. Klaas

[57] ABSTRACT

In a self-supporting concrete form of foamed polymeric material, a one piece transverse connecting member is provided which mechanically holds fastening members inserted into the form providing mechanical support for finish material such as furring strips, paneling, etc. The connecting member is formed from one piece of sheet material, preferably cold rolled steel, and comprises a central connecting web portion extending between and embedded in sidewall members of the form and first and second imperforate flat attachment flange portions extending perpendicularly from the web portion and embedded near the outer surfaces of the sidewall members for supportably receiving fastening members penetrating the sidewall members. The web portion of the connecting member comprises an array of relatively large openings to permit the flow of concrete through the form units and to provide a high strength web of metal. The connecting members may be arranged in each form unit with one connecting member midway between the longitudinal center and each end of the form unit so that, when the form units are laid up in courses in a staggered array, the connecting members of form units in succeeding courses are aligned.

11 Claims, 5 Drawing Figures

Fig.-4
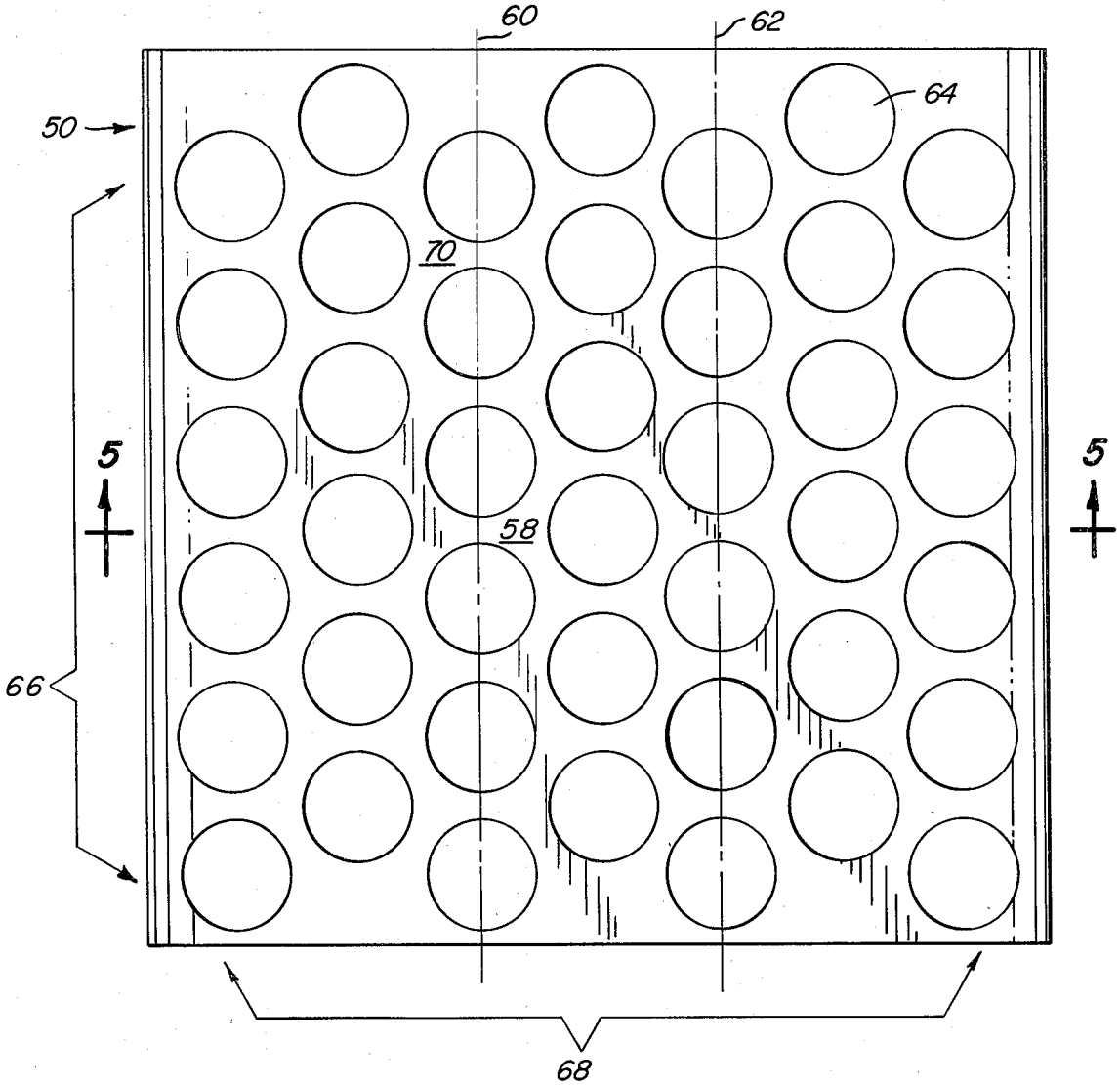
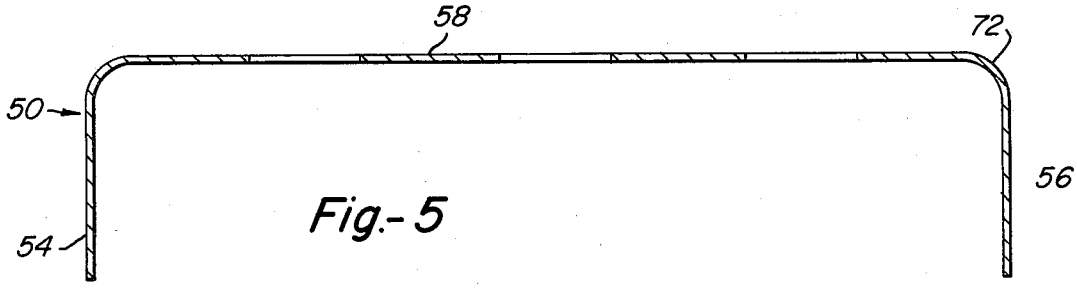
Fig.-5

CONCRETE FORM

BACKGROUND OF THE INVENTION

The present invention relates to construction materials and more particularly to a self supporting concrete form unit of foamed polymeric material of the type described in U.S. Pat. No. 3,778,020, the description of which is incorporated herein by reference thereto.

Briefly, such a concrete form unit is of rectangular block shape and comprises a pair of rectangular sidewall members of the same size and shape which are held in spaced parallel relationship by rigid vertically positioned connecting members (sometimes also referred to in the art as tension members or spreaders) extending laterally therebetween with opposite end portions embedded in the sidewalls.

The inner faces of the sidewall members are provided with spaced laterally inwardly projecting vertically extending rib portions in which the opposite end portions of the spreaders are embedded with the portions of the inner faces of the side wall members between the rib portions and the connecting members defining vertically disposed cavities for concrete. The spreaders are conventionally made of flat, rectangular-shaped, expanded sheet metal providing a plurality of openings to enable receipt of foam material in the embedded end portions of the connecting members during manufacture of the form units and also to enable concrete to flow between the cavities during construction of a form unit wall.

In use, a number of these form units are mounted end to end in a course and one above the other in additional courses in interlocking and interconnected relationship to provide a complete permanent wall form into which reinforcing steel bars are placed and concrete or the like is then poured to form a continuous concrete reinforced wall therewithin with the form units remaining in place thereafter to form part of a building or other structure. During subsequent construction, it is usually necessary to make attachments to the wall structure formed by the concrete and the permanently attached form units. For example, as a building is being finished, it is often desirable to apply a finish covering of lath, sheetrock, paneling, or the like, which must be supportably attached to the form units. In the prior art type of form units, it has been necessary to glue finish materials to the outer surfaces of the form units or to anchor the material in the concrete inside the form units.

The present invention provides an improved concrete form unit having attachment flange means integrally mounted in the side wall members adjacent to the outer surfaces thereof for mechanically receiving and supporting mechanical fastening devices such as self tapping screws, by which finish materials or the like may be more economically and easily and securely fastened to the wall structure.

In the presently preferred embodiment of the invention, the attachment flange means are an integral part of one or more connecting members of new and improved design and which replace expanded metal spreaders in each form unit. The connecting members are made of one piece of flat sheet metal formed into a channel shaped configuration defined by a flat central connecting web portion and transversely extending flat attachment flange means portions. The flat connecting web portion which is mounted in a vertical position between the sidewall members of the form unit and has end portions embedded in the rib portions of the sidewall members, has multiple relatively large openings therein to more readily permit the flow of both plastic foam material and concrete therethrough. The openings may be arcuate or polygonal. If arcuate, they are preferably arranged in rows of staggered openings so that the percentage of the area of the openings relative to the percentage of solid interconnected metal is 75% or more. The flange portions are imperforate solid sheet metal material and extend laterally at substantially right angles to the connecting web portion in substantially parallel relationship to the outer surfaces of the side wall members and are located in relatively closely spaced relationship thereto. The connecting members of each form unit are positioned and arranged in a predetermined pattern so that the fastener attachment flange portions of each form unit will be vertically aligned between succeeding courses.

BRIEF DESCRIPTION OF THE DRAWING

FIG. 4 is a plan view of a connecting member of the present invention; and

FIG. 5 is an end sectional view of the connecting member of FIG. 4 taken along line 4—4.

DESCRIPTION OF THE PREFERRED EMBODIMENT

Figure 2:
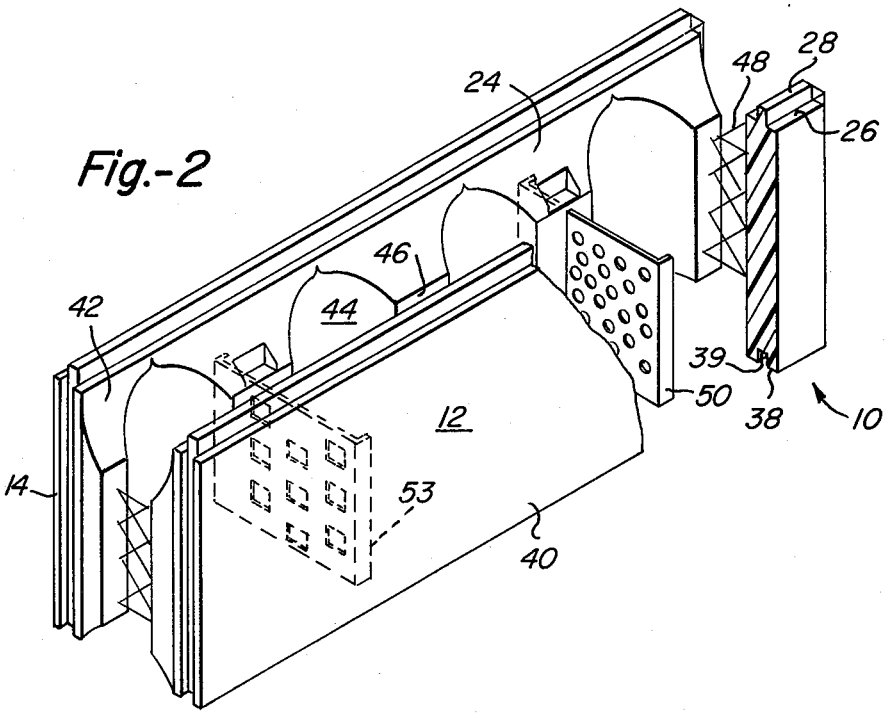
FIG. 2 is a perspective view of a form unit of the present invention with portions removed for clarity.
Figure 3:
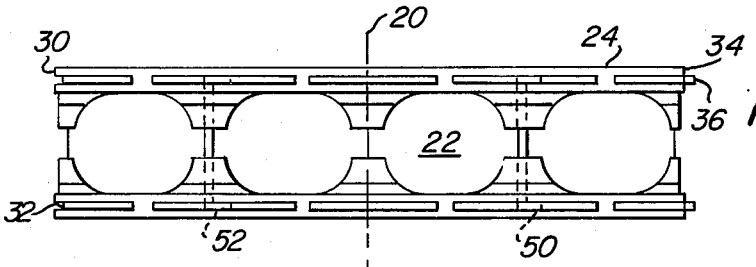
FIG. 3 is a plan view of the form units of FIG. 2.
Figure 1:
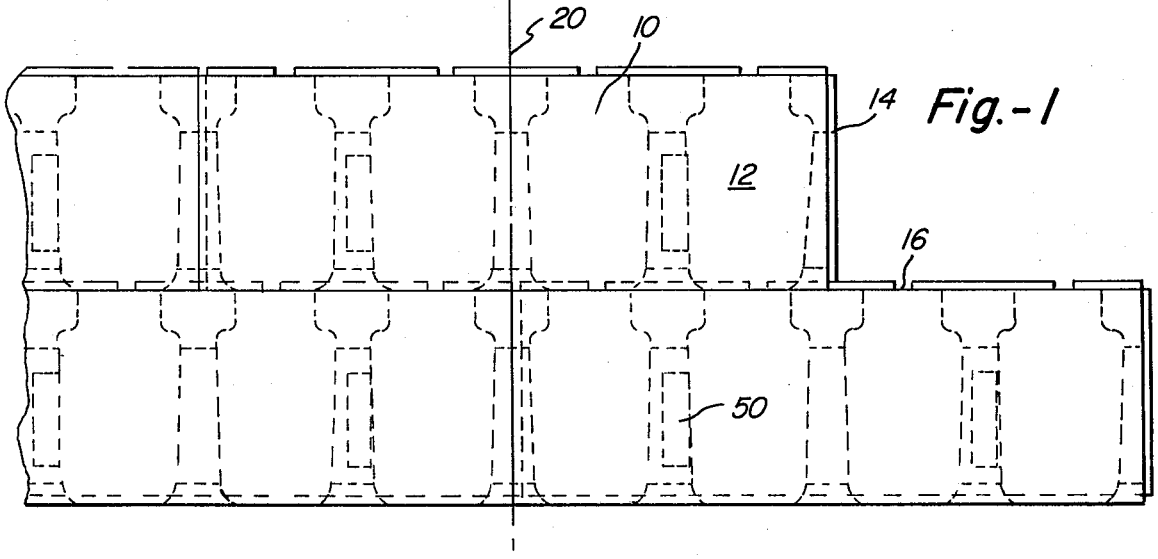
FIG. 1 is a side view of a structural wall built with a plurality of form units of the present invention.

Referring now to FIG. 1, an assembly of form units 10 of the present invention are shown laid up in staggered array wherein planar first sidewall members 12 of the form units are arranged in coplanar relationship, and the ends 14, the tops 16, and the bottoms 18 of the form units are in abutting relationship with the end of a form unit 10 in one row being adjacent to a center line 20 extending through the longitudinal midpoint of a form unit in the next adjacent row. When the form units are arranged in this staggered array, greater lateral support is provided, while various mold cavity portions 22 in the form units 10 are in top to bottom alignment. The mold cavity portions, as shown in FIGS. 2 and 3, are defined in each block between the first sidewall member 12 and a second sidewall member 24 parallel to and oppositely symmetrical with the first sidewall member. Each sidewall member is in the form of an elongated rectangle having a linear top edge 26 with a tongue portion 28, a linear forward edge 30 with a groove portion 32, a linear rearward edge 34 with a tongue portion 36 and a linear bottom edge 38, with a groove portion 39. The groove portions 32, 39 receive the tongue portions 28, 36 of adjacent form units as the sidewall members 12, 24 each comprise a smooth rectangular outer surface 40 and a scalloped inner surface 42. The inner surface 42 comprises four regularly spaced concave portions 44 oriented between the top and bottom of the block and separated one from the other by five form unit rib portions 46 extending from the bottom of the block to a portion of outward curvature about three fourths of the distance between the top and the bottom of the form unit. The sidewall members thus form four equally spaced mold cavities 22 through concave portions 44 extending between inwardly extending rib portions 46.

The two sidewall members 12, 24 are held together by a number of cross members 48 extending between the center, forwardmost, and rearwardmost ribs and which serve longitudinally to define the mold cavities 22. Each cross member 48 comprises a length of expanded metal embedded in laterally opposing rib portions 46 during the manufacture of the form unit to provide a relatively narrow space between the ribs of opposing sidewall members and to hold the sidewall members together in parallel relationship. The form unit is preferably manufactured, as is known in the art, of foamed polystyrene. The open mesh of the expanded metal permits the flowable construction material which is poured into the block assembly to flow among the adjacent form units and mold cavities. Two one piece transverse connecting members 50, 52 are also embedded in the sidewall members 12, 24 during the manufacture of the form unit to extend perpendicularly between the sidewall members from opposing rib portions thereof. The connecting members 50, 52 serve to longitudinally define mold cavities 22 and to supportably position the sidewall members 10, 12. The first connecting member 50 is embedded in the sidewall members 12, 24 to extend from the rib portions 46 midway between the center line 20 of the form unit and the rearward edge 24 of the form unit. The second connecting member 52 is embedded in the sidewall members 12, 24 to extend from the rib portions 46 midway between the center line 20 of the form unit and the forward edge 30 of the form unit. The connecting members 50, 52 are embedded in the sidewall members with their laterally outwardmost portions about one half inch below the outer surfaces 40 of the sidewall members.

Each connecting member 50, 52 used in the present invention is essentially identical. Accordingly, only one connecting member 50 will be described in detail with reference to FIGS. 4 and 5. The laterally outwardmost portions of the connecting member 50 comprise a first flat fastener attachment flange portion 54 and a second flat fastener attachment flange portion 56 which extend at an angle from a flat central connecting web portion 58 of the member. The central web portion 58 is generally rectangular, having its width extending between the flange portions 54, 56, and sized so that the laterally outwardmost portions of the connecting member embedded in the sidewall members include the flange portions and a substantial portion of the planar central web portion. The rib portions 46 extend inwardly more than one third of the width of the web portion, terminating along relatively closely spaced parallel lines 60, 62. The central web portion 58 comprises a plurality of openings 64 which are circular and of relatively large, e.g. one inch, diameter. The openings 64 are arranged in rows and columns of between three and seven openings. Seven columns 66 extend along the length of the central web portion, and seven rows 68 extend across the width of the web portion. The openings 66 are regularly equally spaced from each other. Being arcuate, they are offset from each other in adjacent rows and columns so that they define between them a uniform web 70 of sheet material having an area less than 25% of that of the openings. The opening pattern provides a high strength web which provides uniform support in all directions.

As shown in connection with connecting member 53, the openings may also be polygonal, or square, and arranged in parallel rows and columns.

The first and second flange portions 54, 56 are each joined to the web portion 58 through a curved shoulder portion 72. The array of openings 64 extends substantially the entire length and width of the web portion, but the laterally outwardmost columns 66 of openings do not extend into the shoulder portions 72. The first and second flange portions 54, 56 each extend normally from the center portion in the same direction so that they are arranged in opposing parallel to face relationship. Each is coextensive with the length of the center portion, imperforate, and of the same approximate width, e.g. 1.5 in. (3.9 cm), and forms a continuous planar surface to mechanically receive self-tapping fastening members.

The web and flange portions of the connecting member are stamped and bent from a single flat sheet of metal, preferably cold rolled steel, of a gauge, e.g. 24–28 gauge, selected so that the flange portions are constructed to receive therethrough self-tapping screws.

Thus, in the use of the present concrete form units, the form units are laid up to provide a self-supporting form and filled with flowable construction material in a conventional way. Then, when the structure is to be finished, paneling, plasterboard, sheeting, furring strips, studs, wire mesh, etc. can be affixed to the structure through fastening members anchored in the flange portions of the connecting members. The connecting members, being rigidly fixed in the construction material, provide sturdy mechanical support to the finishing material applied to the block structure. The preferred fastening members are standard self-tapping screws used in conjunction with electric screw guns. The flange portions of the connecting members are regularly spaced just inside the outer surfaces of the form units and can be rapidly located with templates or markings on the form units. Templates may be held against the structure for location of the flanges or the form units may comprise colored markings on their outer surfaces above the flange portions. Alternatively, the outer surfaces above the flange portions may be broken away to reveal the flange portions. The connecting members are arranged in repeating patterns so that the connecting members in succeeding courses of form units are aligned when the units are laid up in staggered relationship. This permits the solid anchoring of finishing materials furring strips, or the like.

While the inventive concepts have been disclosed with reference to an illustrative and presently preferred embodiment thereof, it is intended that the appended claims be construed as including alternative embodiments, except insofar as limited by the prior art.

What is claimed is:

1. In a self-supporting form of polymeric material comprising first and second sidewall members extending in length on either side of a cavity disposed to receive flowable construction material, the combination comprising:

a one piece transverse connecting member of sheet material extending between and embedded in said first and second sidewall members and comprising:

a central, connecting web portion extending between said first and second sidewall members and serving to define said cavity therebetween, and having therein a plurality of openings for permitting flow therethrough of said flowable construction material; and attachment flange means integral with said central, connecting web portion, extending transversely relative to the central, connecting web portion, embedded in at least one of said sidewall members, and located relatively closely adjacent an outer side surface of one of said sidewall members in a predetermined relationship to said length of the sidewall members for enabling location thereof and fixed mechanical attachment of building materials thereto, said attachment flange means forming a substantially imperforate continuous planar surface for supportably receiving fastening members penetrating a sidewall member.

2. The connecting member of claim 1, wherein said attachment flange means comprises:

a first attachment flange portion extending at an angle from said central connecting web portion, embedded in said first sidewall member and forming a substantially imperforate continuous planar surface for supportably receiving fastening members penetrating the first sidewall member;

a second attachment flange portion extending at an angle from said central connecting web portion, embedded in said second sidewall member and forming a substantially imperforate continuous planar surface for supportably receiving fastening members penetrating the second sidewall member.

3. The connecting member of claim 1 wherein said sheet material is steel.

4. The connecting member of claim 1 wherein said plurality of openings are constructed in regularly spaced rows and columns defining between them a web of sheet material having an area less than the combined area of the openings.

5. The connecting member of claim 4, wherein said openings are arcuate and are offset from each other in adjacent rows and columns.

6. The connecting member of claim 2, wherein said first attachment flange portion and said second attachment flange portion are in opposing parallel relationship.

7. The connecting member of claim 2, wherein said web portion, said first attachment flange portion, and said second attachment flange portion are substantially in the form of rectangles coextensive with said web portion.

8. The connecting member of claim 2, wherein said first attachment flange portion and said second attachment flange portion extend at substantially right angles from said central connecting web portion.

9. The form of claim 1, wherein said transverse connecting member is embedded in the form midway between a longitudinal center and an end of the form.

10. The form of claim 1, wherein said transverse connecting member is embedded in the first and second sidewall members in combination with a second similar transverse connecting member, each connecting member being embedded midway between a longitudinal center and an end of the form.

11. In a self-supporting form of polymeric material comprising first and second sidewall members extending in length on either side of a cavity disposed to receive flowable construction material, the combination comprising:

a first one piece transverse connecting member of sheet material extending between and embedded in said first and second sidewalls, having a perforate central web portion having top and bottom edges and a pair of substantially imperforate attachment flanges on either side of said central web portion extending continuously between said top and bottom edges and located relatively closely adjacent outer side surfaces of the sidewall members; and a second one piece transverse connecting member, substantially identical to said first one piece connecting member and embedded in said first and second sidewalls a predetermined distance from the first one piece transverse connecting member so that, in a staggered array of a plurality of said self-supporting forms, said first and second one piece transverse connecting members are aligned between succeeding courses.

* * * * *